US009839823B2

(12) United States Patent
Ehlers

(10) Patent No.: US 9,839,823 B2
(45) **Date of Patent: *Dec. 12, 2017**

(54) CG HEIGHT ADJUSTABILITY BY CONFORMAL CROWN WEIGHTING

(71) Applicant: Callaway Golf Company, Carlsbad, CA (US)

(72) Inventor: Steven M. Ehlers, Poway, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/230,638

(22) Filed: Aug. 8, 2016

(65) Prior Publication Data

US 2016/0346650 A1 Dec. 1, 2016

Related U.S. Application Data

(63) Continuation of application No. 14/701,926, filed on May 1, 2015, now Pat. No. 9,409,069, which is a (Continued)

(51) Int. Cl.
*A63B 53/06* (2015.01)
*A63B 53/04* (2015.01)
(Continued)

(52) U.S. Cl.
CPC ..... *A63B 53/06* (2013.01); *A63B 53/0466* (2013.01); *A63B 60/52* (2015.10); *A63B 60/54* (2015.10); *A63B 2053/045* (2013.01); *A63B 2053/0433* (2013.01); *A63B 2053/0437* (2013.01); *A63B 2053/0441* (2013.01); *A63B 2053/0491* (2013.01); *A63B 2209/00* (2013.01); *A63B 2209/02* (2013.01)

(58) Field of Classification Search
CPC ..... A63B 53/06; A63B 53/0466; A63B 2053/0491; A63B 2209/00; A63B 2209/02; A63B 2053/0437; A63B 2053/0441; A63B 60/52; A63B 60/54; A63B 2053/0433; A63B 2053/045
See application file for complete search history.

(56) References Cited

U.S. PATENT DOCUMENTS 7,578,753 B2 * 8/2009 Beach ..... A63B 53/0466 473/337
8,172,697 B2 * 5/2012 Cackett ..... A63B 53/0466 473/329

(Continued)

*Primary Examiner* — Stephen Blau
(74) *Attorney, Agent, or Firm* — Rebecca Hanovice; Michael Cantana; Sonia Lari

(57) ABSTRACT

A golf club head comprising a crown with an edge support structure and a flexible, conformal weight sized to fit within the edge support structure is disclosed herein. The edge support structure preferably is disposed on an internal surface of the crown so that the conformal weight is invisible when the golf club head is viewed at address. The conformal weight can be removed to adjust the vertical center of gravity of the club head, and preferably is oriented in a front-to-back direction along the club head's X-axis. The conformal weight preferably is composed of a high-density polymeric material with a specific gravity ranging from 1.8 to 4.2.

19 Claims, 6 Drawing Sheets

Related U.S. Application Data continuation of application No. 14/151,148, filed on Jan. 9, 2014, now Pat. No. 9,022,881, which is a continuation-in-part of application No. 14/050,194, filed on Oct. 9, 2013, now Pat. No. 8,690,708, which is a continuation-in-part of application No. 13/797,404, filed on Mar. 12, 2013, now abandoned.

(60) Provisional application No. 61/657,247, filed on Jun. 8, 2012.

(51) Int. Cl.
*A63B 60/52* (2015.01)
*A63B 60/54* (2015.01)

(56) References Cited

U.S. PATENT DOCUMENTS

| | | | | |
|---|---|---|---|---|
| 8,684,863 | B2 * | 4/2014 | Bezilla | A63B 53/06 473/334 |
| 2004/0116207 | A1 * | 6/2004 | De Shiell | A63B 53/0466 473/345 |
| 2013/0324299 | A1 * | 12/2013 | Clausen | A63B 53/06 473/335 |

* cited by examiner

CG HEIGHT ADJUSTABILITY BY CONFORMAL CROWN WEIGHTING

CROSS REFERENCES TO RELATED APPLICATIONS

The present application is a continuation of U.S. patent application Ser. No. 14/701,926, filed on May 1, 2015, and issued on Aug. 9, 2016, as U.S. Pat. No. 9,409,069, which is a continuation of U.S. patent application Ser. No. 14/151,148, filed on Jan. 9, 2014, and issued on May 5, 2015, as U.S. Pat. No. 9,022,881, which is a continuation-in-part of U.S. patent application Ser. No. 14/050,194, filed on Oct. 9, 2013, and issued on Apr. 8, 2014, as U.S. Pat. No. 8,690,708, which is a continuation-in-part of U.S. patent application Ser. No. 13/797,404, filed on Mar. 12, 2013, now abandoned, which claims priority to 61/657,247, filed on Jun. 8, 2012.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a conformal weight for a golf club head.

Description of the Related Art

Relatively little has been done with the placement of adjustable weights directly in the crowns of drivers. Positioning weights in a crown, especially near its highest point, is very effective in moving the vertical position of the center of gravity, and also is useful for controlling golf ball backspin, allowing the vertical component of golf ball trajectory to be optimized for different head speeds, swing styles and player preference. Unfortunately, achieving sufficient center of gravity range is difficult, such installations are visually distracting at address, the fixed structure of a weight port is inefficient and penalizes overall performance, and a concentrated mass located in the center of the crown can have an adverse effect on impact sound. Furthermore, impact sound may be noticeably different for different weighting configurations.

There are ways to deal with the appearance of a weight in the center of the crown. For instance, it is possible to cover the weight port with a medallion or cover piece. Unfortunately, this adds to the fixed portion of the adjustable weighting system mass and further detracts from its efficiency. The cover can also become a source of buzzing or can become detached and possibly lost. Mitigating such impact sound effects typically requires stiffeners, an increase in crown thickness, or both. Both of these approaches add to the fixed structural weight of the crown and tend to increase the center of gravity height.

Weight ports in the crown that are visible at address are not desirable. They are potentially distracting and can impact cosmetic appearance. In addition, the weight port structure adds to total crown mass. This additional fixed crown mass raises center of gravity of the head and provides little contribution to other important characteristics such as moment of inertia. In a typical weight port configuration the weight is contained within the outer mold line of the head.

For a crown weight this means that its position is lower than ideal, thus reducing the achievable vertical center of gravity range.

BRIEF SUMMARY OF THE INVENTION

The objective of this invention is to provide an adjustable crown weight with minimal or no effect on appearance at address while maximizing the ability of the weight to adjust center of gravity height. Additional goals include minimizing the fixed component of the structure dedicated to the weighting system and also minimizing any potential effect on impact sound.

Yet another object of the present invention is an adjustable weighting feature for vertical center of gravity control which is placed to maximize effectiveness and may be entirely concealed from view at address.

Yet another object of the present invention is an adjustable weighting feature for vertical center of gravity control which is placed to maximize effectiveness and is only visible at address on the aft portion of the crown.

Yet another object of the present invention is an adjustable weighting feature for vertical center of gravity control which is placed to maximize effectiveness and may also serve as an alignment aid.

Another aspect of the present invention is a golf club head comprising a face component comprising a face component contact surface, a crown comprising a crown front edge, a crown aft edge, an edge support structure, and an aft opening in communication with the edge support structure, and a flexible weight comprising a weight front edge, a width, a depth, a length, and a weight rear edge, wherein the aft opening is sized to receive the flexible weight, wherein the flexible weight is removably retained within the edge support structure, and wherein the length of the flexible weight is greater than the width of the flexible weight.

In some embodiments, the weight front edge may abut one of the crown front edge and the face component contact surface when the weight is fully engaged within the edge support structure. In some embodiments, the golf club head may further comprise a sole having at least one weight port. In other embodiments, the crown may be composed of composite, and may comprise a doubly curved shallow shell structure. In other embodiments, the flexible weight may be aligned with a golf club head X-axis when the flexible weight is engaged with the edge support structure. In still other embodiments, the edge support structure may be integrally formed with the crown. In another embodiment, the flexible weight may comprise a polymer having a specific gravity value of 1.8 to 4.2.

In still other embodiments, the edge support structure may be selected from the group consisting of internal rails, an internal enclosed support structure, and external rails. In a further embodiment, the edge support structure may be internal rails, and the crown may comprise an opening disposed over the internal rails to form an external channel. In another embodiment, the weight front edge may have a shape selected from the group consisting of rectangular, tapered, and rounded. In another embodiment, the flexible weight may comprise a plurality of cutouts, which may be disposed at an edge of the flexible weight. In still other embodiments, the flexible weight may be preloaded when it is fully engaged with the edge support structure. In a further embodiment, the golf club head may comprise a fastener, which may place the flexible weight in compression within the edge support structure. This fastener may be a weight screw or a retainer clip or snap, or a combination thereof. In yet another embodiment, the flexible weight may have an initial un-deformed shape comprising a curvature that matches a curvature of the crown. In another embodiment, the golf club head may further comprise a damping layer disposed between the flexible weight and an interior surface the crown.

Another aspect of the present invention is a driver-type golf club head comprising a face component comprising a face component contact surface, a molded composite crown comprising a crown aft edge, an internal surface, and an edge support structure disposed on the internal surface, a weight composed of a high density polymeric material, and a fastener, wherein the edge support structure is integrally formed with the crown, wherein the weight comprises a rectangular shape and a tapered front edge, wherein the weight is retained within the edge support structure, wherein the weight is aligned with a golf club head X-axis when the weight is engaged with the edge support structure, and wherein the weight is compressed between the fastener and the face component contact surface. In some embodiments, the weight may be hidden from view when it is fully engaged with the edge support structure. In another embodiment, the weight may comprise a plurality of weight protrusions. In yet another embodiment, the weight may comprise a thick-edged cross-sectional shape.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
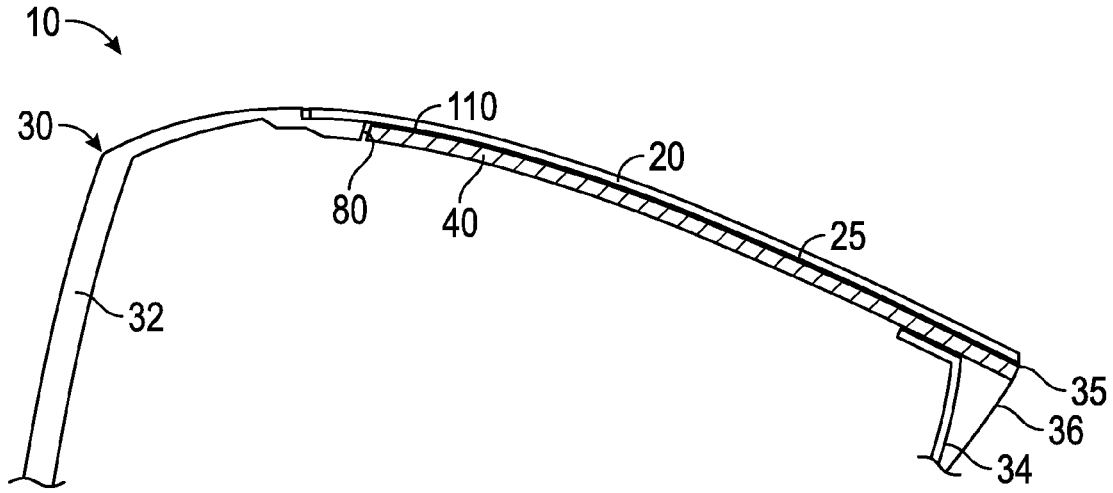
FIG. 1 is a cross-sectional view illustrating a position of a conformal weight within a golf club head.

As shown in FIG. 1, the design approach described here is based on the construction used in Callaway Golf Company's RAZR Fit driver head 10, characterized by a composite crown 20 adhesively bonded to a cast Titanium body 30, which comprises a face 32, a sole 34, and sometimes a ribbon 36. This particular construction approach permits the crown 20 configuration to be adapted to the hidden conformal weighting system 100 described herein with minimal impact to weight and function. However, this weighting system 100 may be used with other constructions including all Titanium, all composite and composite body with metal face cup. It is also intended to work in conjunction with at least one adjustable weight port on the sole of the driver head 10. Shifting weight between the crown weighting system 100 described herein and a port located on the sole 34 allows for control of center of gravity height. In the most general case the sole 34 weighting technique will be different than the crown 20.

Figure 2:
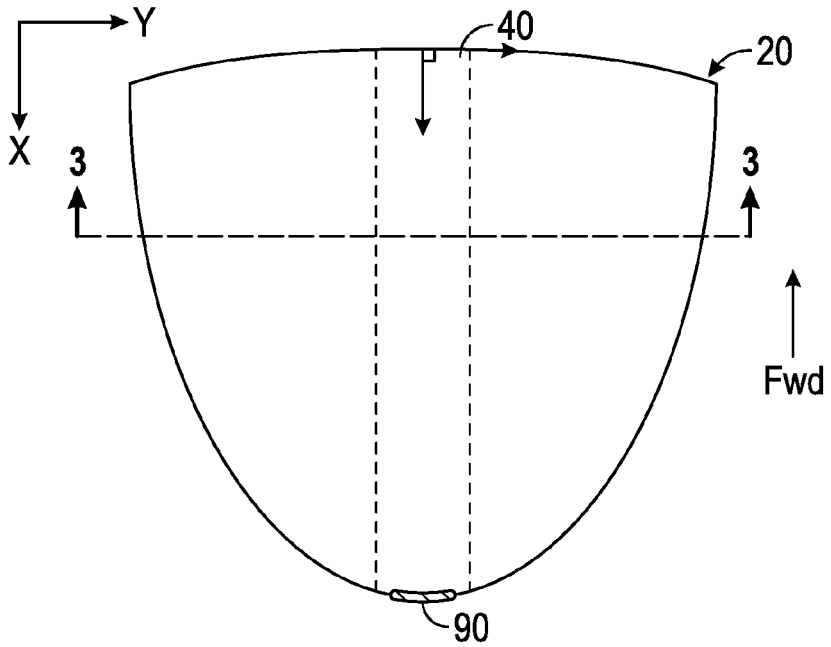
FIG. 2 is a plan view of a crown of a golf club head illustrating an orientation of a conformal weight and a local shell coordinate system.

In the primary configuration, shown in FIG. 1, the crown 20 is a doubly curved composite shallow shell structure adhesively bonded to the body 30 at its perimeter 35. The weight 40 is termed conformal in that it closely follows the crown 20 shape to maximize its height and effect on vertical center of gravity position. The conformal weight 40 preferably is oriented front to back and aligned close to the head X-axis, as shown in FIG. 2. However, the conformal weight 40 can be angled with respect to the head X-axis to accommodate performance or alignment needs without significant reduction in performance.

Figure 3A:
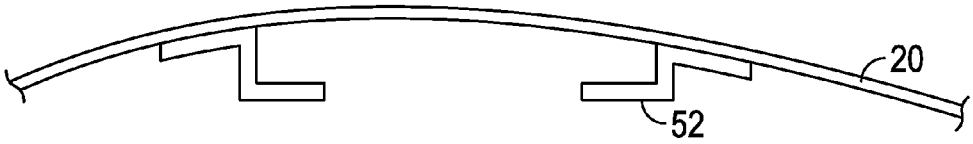
FIGS. 3A-3D illustrate cross-sectional configurations of different conformal weight installation sections on a crown of a golf club head.
Figure 3B:
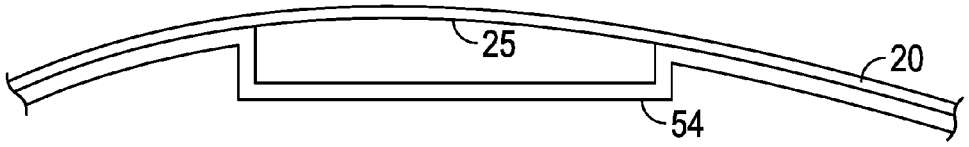
Figure 3C:
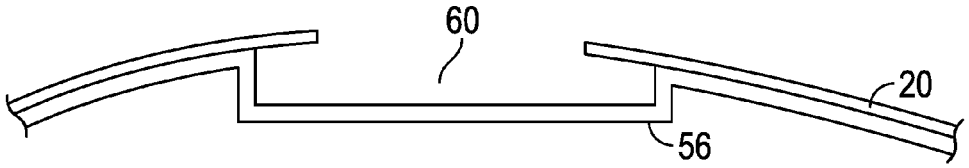
Figure 3D:
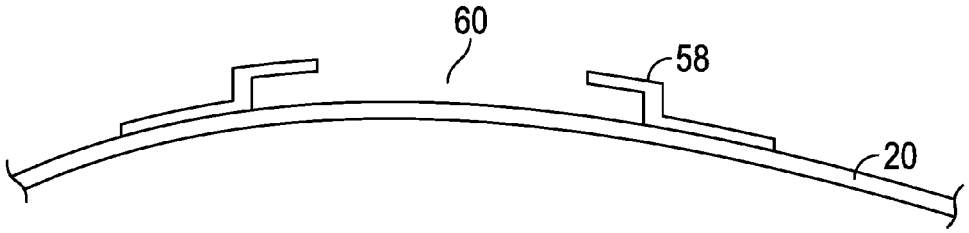

To hold the conformal weight 40, the internal surface 25 of the crown 20 is modified by the addition of edge support structures 50, oriented fore and aft and aligned essentially parallel to the head Y-axis. These support structures 50 may be integrally molded from the crown 20 parent material or be secondarily bonded to the crown 20. In the preferred embodiment, shown in FIG. 3A, the crown 20 comprises internal edge rails 52 which hold the conformal weight 40 in place. In an alternative embodiment, the crown 20 comprises an internal enclosed support structure 54, which completely sandwiches the conformal weight 40 between the support structure 54 and the internal surface 25 of the crown 20 as shown in FIG. 3B. In another embodiment, shown in FIG. 3C, the crown 20 is formed with an external channel 60 oriented fore and aft with internal edge rails 56 at the lateral edges of the channel 60 to hold the weights in place. In this approach, the conformal crown weight 40 is visually apparent, but its visual effects are minimized by finishing the conformal weight 40 in a manner identical to the surrounding crown 20. Alternatively, the conformal weight's 40 geometry and cosmetics can be intentionally configured in a manner to make it an alignment aid at address. In yet another embodiment, external edge rails 58 are formed with or added to the crown 20 as shown in FIG. 3D. A benefit of these edge support structures 50 is that they increase stiffness of the crown 20 to counteract the mass effect of the conformal weights 40, thus mitigating effects on vibrational behavior. In this manner the edge supports 50 serve two functional roles; stiffener and weight guide.

Figure 4A:
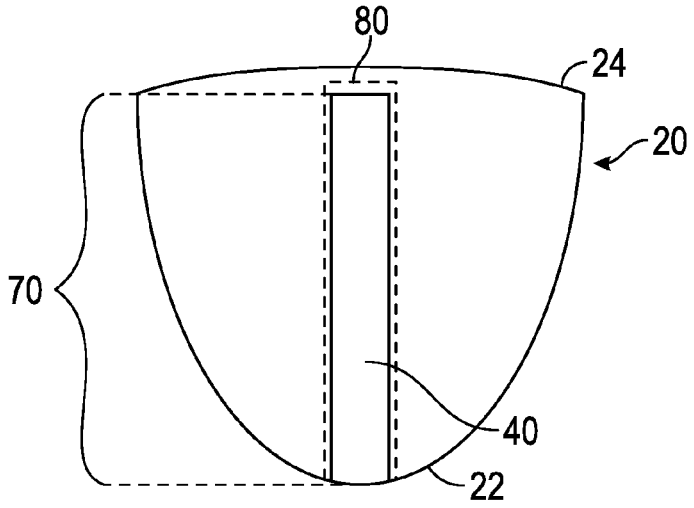
FIGS. 4A-4C illustrates multiple crowns of golf clubs with varying weight concealment ranging from fully hidden, aft section exposed and full exposed.
Figure 4B:
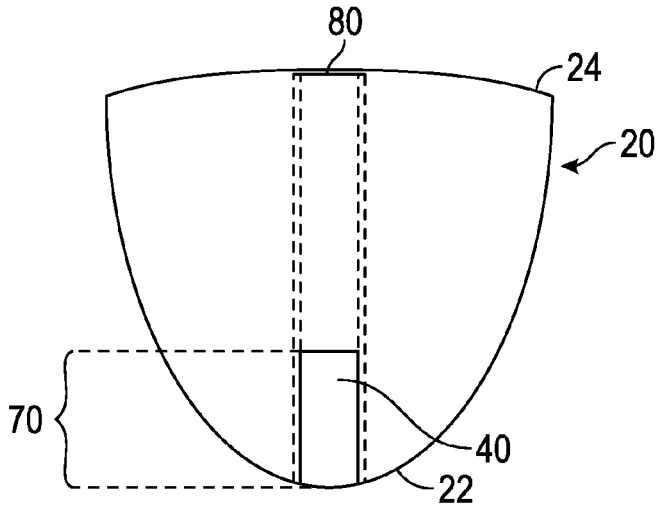
Figure 4C:
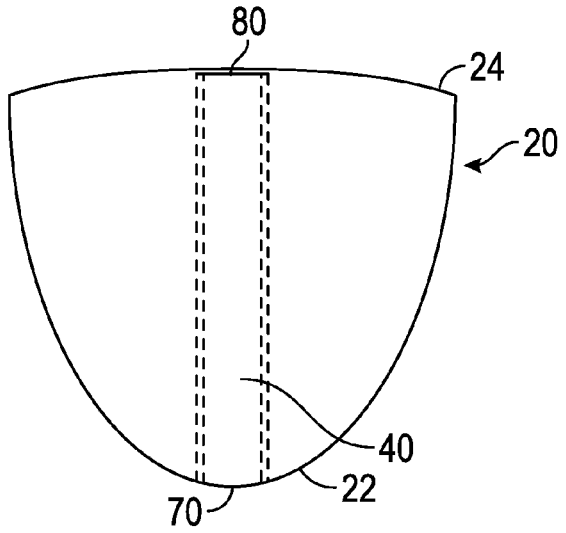

The conformal weights 40 of the present invention preferably are inserted into or removed from the crown 20 via an opening 70 at the aft edge 22 of the crown 20 or, in an alternative embodiment, via an aft section of the ribbon portion of the body (not shown). In the embodiment shown in FIG. 4A, the opening 70 extends the entire length of the crown 20 along the X-axis, thus forming an external channel 60. In the embodiment shown in FIG. 4B, the opening 70 extends approximately one third of the length of the crown 20 along the X-axis, while in FIG. 4C, the opening 70 is located entirely at the aft edge 22 of the crown 20.

Figure 5A:
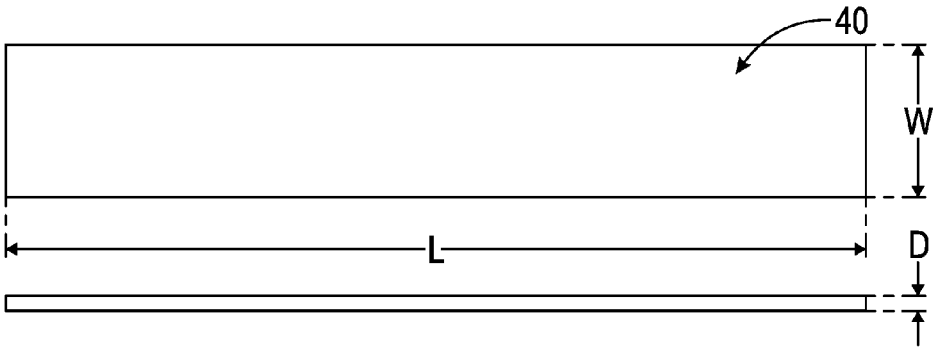
FIGS. 5A-5D illustrate multiple configuration and construction options for a flexible conformal weight for a golf club head.
Figure 5B:
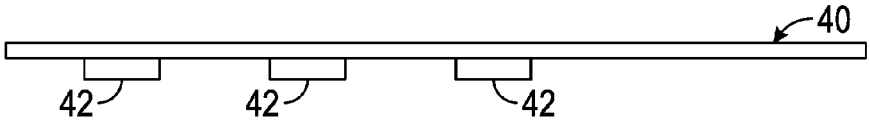
Figure 5C:
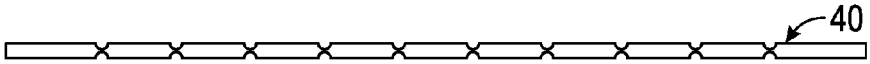
Figure 5D:
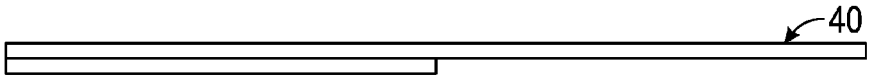

The conformal weights 40 of the present invention preferably are thin flexible elements sized to fit within the edge support structure 50 and to follow the curvature of the crown 20. In the preferred embodiment, shown in FIG. 5A, the conformal weight 40 is a flexible strip of material having a consistent length L, width W, and depth D. In an alternative embodiment, shown in FIG. 5B, the conformal weight 40 is a flexible strip of material having attached weight protrusions 42. In another embodiment, shown in FIG. 5C, the conformal weight 40 is segmented such that it does not have a consistent depth D. In yet another embodiment, the conformal weight 40 is laminated so that it has a variable depth D.

Figure 6A:
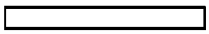
FIGS. 6A-6D illustrate multiple cross-section options for a flexible conformal weight for a golf club head.
Figure 6B:
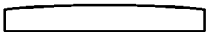
Figure 6C:
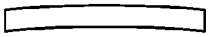
Figure 6D:
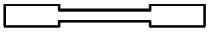

A range of weight values for the conformal weights 40 of the present invention can be achieved using loaded polymers or a polymer substrate with attached weights. High density polymers with sufficient bending flexibility exist with specific gravity values ranging from 1.8 to 4.2. Another approach is to use segmented conformal weights 40 with flexible connectors. It is also possible to attach conformal weights 40 to a flexible substrate or laminate highly loaded polymer layers to a flexible substrate. Mass distribution within the flexible weight does not have to be evenly distributed. In fact, it is beneficial to concentrate weight near the forward half of the conformal weight 40 to maximize its effect on center of gravity height. The conformal weight 40 also need not be flat, as shown in FIGS. 6A and 6B. Instead, in the preferred embodiment, the initial un-deformed shape of the conformal weight 40 includes a slight curvature that is similar to the crown 20 contour to reduce insertion contact forces and the resulting friction. In yet another embodiment, shown in FIG. 6D, the conformal weight 40 may have a thick-edged cross-sectional shape. In general, the cross-sectional shape of the conformal weight 40 must provide sufficient volume while maintaining flexibility to permit easy insertion and removal.

Figure 7A:
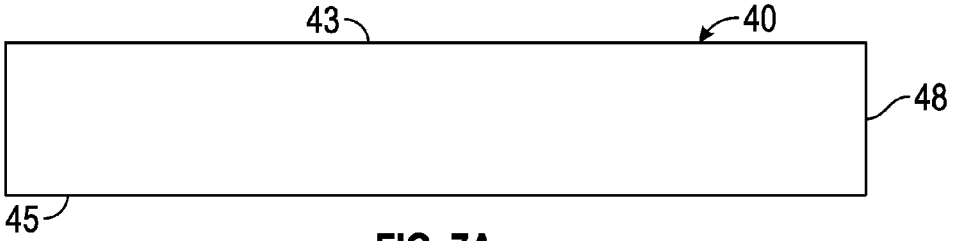
FIGS. 7A-7E illustrate multiple alternatives for a flexible conformal weight for a golf club head.
Figure 7B:
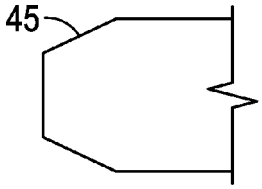
Figure 7D:
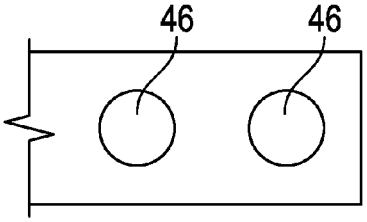
Figure 7C:
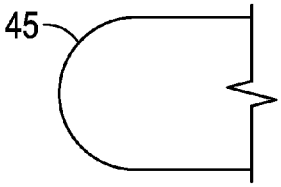
Figure 7E:
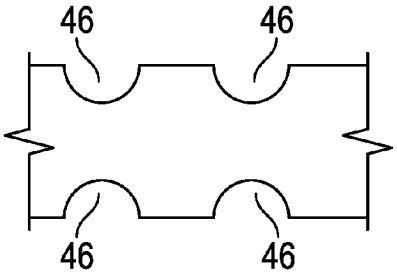

The conformal weights 40 of the present invention preferably are inserted via the aft opening 70 and move along the edge support structures 50 until the conformal weights 40 engage with a contact surface 80 disposed proximate at the forward edge of the crown 20, as shown in FIGS. 1 and 4A-4C. This allows the high loads caused by impact to be taken in bearing and transferred directly to the crown 20 structure of the face cup, if one is used. In one embodiment, the shape of the conformal weight 40 is a simple rectangle, as shown in FIG. 7. In the preferred embodiment, the front edge 45 of the conformal weight 40 is modified with a taper, as shown in FIG. 7B, to improve engagement and alignment of the conformal weight 40 at the contact surface 80. In an alternative embodiment, the front edge 45 of the conformal weight is modified with a rounded section, as shown in FIG. 7C. Reducing weight and increasing flexibility of the conformal weight 40 is accomplished by including cutouts 46 in the center of the conformal weight 40 or along its edge 43. Minimizing vibration and buzz of the conformal weights 40 can be achieved by adding snubbers or a damping layer 110 between the weight and crown surface, but these elements must be carefully designed to avoid adding unnecessarily to the force required to insert or remove the conformal weight 40.

Figure 8A:
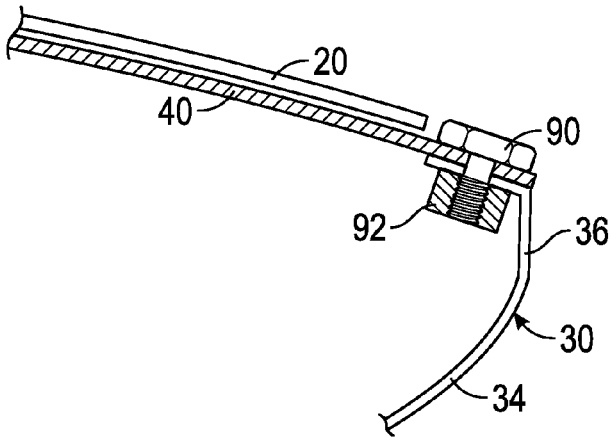
FIGS. 8A-8C illustrate cross-sectional configurations of multiple types of fasteners that can be used to secure the flexible conformal weight to the golf club head.
Figure 8B:
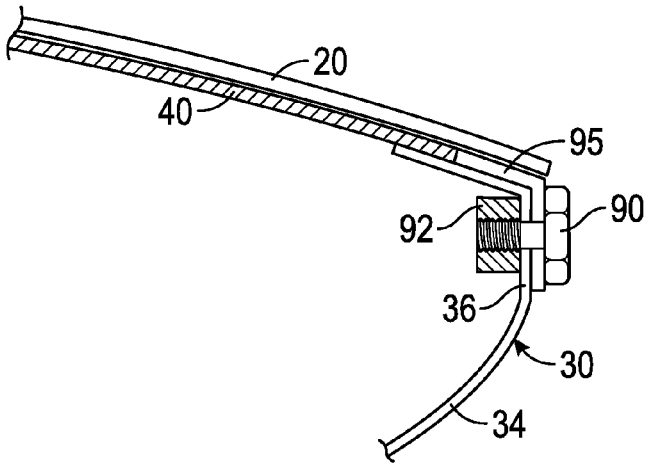
Figure 8C:
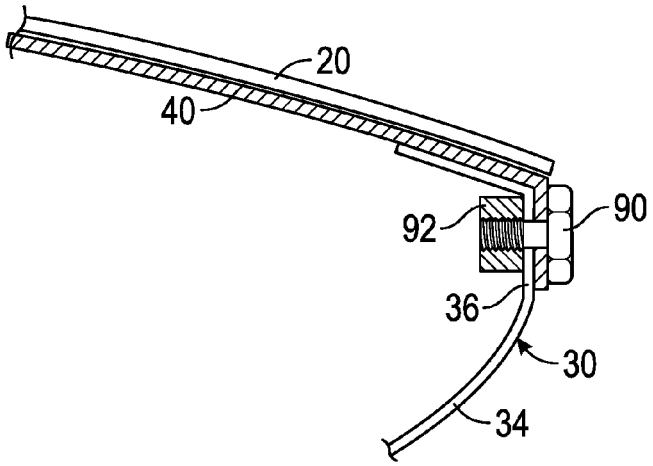

A fastener 90 at the aft edge 22 of the crown 20 or on the aft ribbon section as shown in FIGS. 2 and 8A, 8B, and 8C is used to secure the conformal weight 40 for play. The fastener 90 ideally preloads the conformal weight 40 in compression to minimize vibration and ensure proper load transfer at impact. This is possible because the predominant load at impact is taken in compression by the front edge 45 of the conformal weight 40 near the face 32. Out of plane and lateral loads are absorbed by the edge support structures 50. The fastener 90 also serves as a swingweight adjustment weight, if needed, as shown in FIGS. 8A-8C. In these Figures, the fastener 90 is a weight screw that moves mass towards the rear end of the golf club head 10, on the crown 20 or the ribbon 36. As shown in these Figures, the weight screw fastener 90 extends through openings (not shown) in the conformal weight 40, the crown 20, and the body 30 to secure these structures together. A washer 92 can be affixed to the threads of the weight screw fastener 90 to prevent it from moving, or the body 30 may comprise a threaded port (not shown) to engage the weight screw fastener 90. Alternatively, or in addition to the fastener 90 as shown in FIG. 8B, a snap fit or clip restraint fastener 95 can be used at the aft end 48 of the conformal weight 40.

The approaches detailed herein are well suited to a composite crown due to its extremely low structural weight. The composite may be a discontinuous short or long fiber molded composite or a laminated composite. It is also possible to utilize aluminum, magnesium or titanium alloy.

Varying the amount of weight in the crown may have an effect on driver sound at impact. A relatively flexible conformal weight 40 will mass load the crown 20, thus affecting vibration modes with significant crown 20 participation. This effect can be mitigated by the use of stiff edge support structures 50 and matching the stiffness of the conformal weight system 100 to the local crown 20 structure.

In alternative embodiments, the conformal weighting configurations, including the edge support structures and weights, disclosed herein are used in connection with a composite sole 34 of the golf club head 10 instead of the crown 20, and/or a ribbon 36.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf club head comprising:

a face component comprising a face component contact surface;

a sole;

a crown; and a flexible weight comprising a first front edge, a width, a length, a rear edge, and at least one cutout, wherein the flexible weight comprises a polymer having a specific gravity value of 1.8 to 4.2, wherein at least one of the sole and the crown comprises a second front edge, an aft edge, and an edge support structure, wherein the flexible weight is retained within the edge support structure, wherein a damping layer is disposed between the flexible weight and an interior surface of the crown or the sole, and wherein the length of the flexible weight is greater than the width of the flexible weight.

2. The golf club head of claim 1, wherein the first front edge abuts one of the second front edge and the face component contact surface when the weight is fully engaged within the edge support structure.

3. The golf club head of claim 1, wherein at least one of the crown and the sole comprises at least one weight port.

4. The golf club head of claim 1, wherein at least one of the crown and the sole is composed of composite and comprises a doubly curved shallow shell structure.

5. The golf club head of claim 1, wherein the flexible weight is aligned with a golf club head X-axis when the flexible weight is engaged with the edge support structure.

6. The golf club head of claim 1, wherein the edge support structure is integrally formed with at least one of the crown and the sole.

7. The golf club head of claim 1, further comprising an aft opening in communication with the edge support structure, wherein the aft opening is sized to receive the flexible weight.

8. The golf club head of claim 1, wherein the edge support structure is selected from the group consisting of internal rails, an internal enclosed support structure, and external rails.

9. The golf club head of claim 8, wherein the edge support structure is internal rails, and wherein at least one of the sole and the crown comprises an opening disposed over the internal rails to form an external channel.

10. The golf club head of claim 1, wherein the weight front edge has shape selected from the group consisting of rectangular, tapered, and rounded.

11. The golf club head of claim 1, wherein the flexible weight comprises a plurality of cutouts.

12. The golf club head of claim 11, wherein each of the cutouts is disposed at an edge of the flexible weight.

13. The golf club head of claim 1, wherein the flexible weight has an initial un-deformed shape comprising a curvature that matches a curvature of the crown or the sole.

14. A golf club head comprising:

a face component comprising a face component contact surface;

a sole comprising a sole aft edge, an internal surface, and an edge support structure disposed on the internal surface;

a weight composed of a polymeric material; and a fastener, wherein the edge support structure is integrally formed with the sole, wherein the weight comprises a rectangular shape, wherein the weight is removably retained within the edge support structure, and wherein the weight is compressed between the fastener and the face component contact surface.

15. The golf club head of claim 14, wherein the weight is hidden from view when it is fully engaged with the edge support structure.

16. The golf club head of claim 14, wherein the weight comprises a plurality of weight protrusions.

17. The golf club head of claim 14, wherein the weight comprises a thick-edged cross-sectional shape.

18. The golf club head of claim 14, wherein the weight comprises a plurality of cutouts.

19. The golf club head of claim 14, further comprising a damping layer disposed between the flexible weight and an interior surface of the sole.

* * * * *